US005515630A

United States Patent [19]

Maher

[11] Patent Number: 5,515,630

[45] Date of Patent: May 14, 1996

[54] ADJUSTABLE PICTURE FRAME

[76] Inventor: Patricia Maher, 102 S. 68th Ave., Omaha, Nebr. 68132

[21] Appl. No.: 185,268

[22] Filed: Jan. 24, 1994

[51] Int. Cl.[6] ..... A47G 1/06

[52] U.S. Cl. ..... 40/739

[58] Field of Search ..... 40/155, 152, 152.1, 40/158.1; 403/292, 298

[56] References Cited

U.S. PATENT DOCUMENTS

| | | | |
|---|---|---|---|
| 205,250 | 6/1878 | Davis . | |
| 1,305,121 | 5/1919 | Klimowicz . | |
| 1,319,513 | 10/1919 | Colegrove . | |
| 1,338,258 | 4/1920 | Smith . | |
| 1,421,301 | 6/1922 | Petrow . | |
| 1,446,367 | 2/1923 | Zelan | 40/155 |
| 1,558,987 | 10/1925 | Kallscheuer | 40/155 |
| 2,790,259 | 4/1957 | Havens | 40/155 |
| 2,819,549 | 1/1958 | Tester | 40/155 |
| 3,668,799 | 6/1972 | Sharron | 40/152.1 |
| 3,830,278 | 8/1974 | Packer | 40/152 X |
| 4,399,625 | 8/1983 | Langan | 40/155 |
| 4,691,818 | 9/1987 | Weber | 403/292 X |
| 4,701,066 | 10/1987 | Beam et al. | 403/298 |
| 4,833,803 | 5/1989 | Schwartz | 40/152 |
| 4,839,974 | 6/1989 | Walter | 40/152 |
| 5,199,201 | 4/1993 | Vilims | 40/155 X |

FOREIGN PATENT DOCUMENTS

| | | | |
|---|---|---|---|
| 280416 | 4/1952 | Sweden | 40/152 |

*Primary Examiner*—Jose V. Chen
*Assistant Examiner*—James O. Hansen
*Attorney, Agent, or Firm*—John A. Beehner

[57] ABSTRACT

An adjustable picture frame includes a generally polygonal frame having a plurality of elongated side sectional pieces, each side sectional piece including a first end face having a longitudinally projecting dowel and a second end face having a dowel receiving socket. The frame also includes a plurality of right angled corner sectional pieces for completing the frame, each corner sectional piece including a first elongated arm section having a first section end face with a longitudinally projecting dowel and a second elongated arm section including a second section end face opposite and perpendicular to the first section end face and including a dowel-receiving socket. The first and second arm sections are connected to each other to form a generally L-shaped right angle corner sectional piece. The corner sectional pieces are adapted to contact adjacent side sectional pieces with the dowel on one sectional piece fitting into the dowel-receiving socket of another thereby completing the polygonal frame. Finally, a securement device such as a pin is mounted on the frame to properly secure adjacent sectional pieces in dowel within socket alignment.

9 Claims, 4 Drawing Sheets

ADJUSTABLE PICTURE FRAME

BACKGROUND OF THE INVENTION

1. Technical Field

This invention relates to adjustable picture frames and, more particularly, to an adjustable picture frame including a plurality of side sectional pieces each having a dowel mounted on one end and dowel-receiving socket formed in the opposite end and a plurality of right angle corner sections for completing the frame, each including a dowel extending from one end and a dowel-receiving socket formed on the opposite end, the side sections and corner sections being combined to form a generally polygonal frame.

2. Description of the Prior Art

Pictures, photographs and prints all come in a variety of sizes. Additionally, as most pictures are relatively fragile, it is desirable to provide for protection of a picture. For this reason, a frame is often provided for mounting the picture, thereby protecting the picture from damage caused by water or other such exposure.

However, because pictures come in variety of sizes, a large variety of frame sizes must be manufactured to fit each and every picture desired to be framed. As providing such a wide variety of frame sizes may be prohibitively expensive, there is a need to provide an adjustable picture frame which may be adjusted to enclose a variety of picture sizes.

Several examples of such adjustable framing devices are shown in the prior art. For example, Klimowicz, U.S. Pat. No. 1,305,121, discloses a changeable window display sign in which a plurality of frame sections are connected to one another by a tenon and a mortise which interfit when the sections are united. The sections are secured to one another by a flexible strip of material which extends from a nail attached on the outer edge of the frame around each of the sections and is connected to another section on the frame. Clearly, however, Klimowicz cannot accommodate all sizes of pictures, as the smallest possible adjustment is the length of one section of the frame, especially as each of the sections has the same length. Therefore, there is a need for an adjustable picture frame which will provide for fractional adjustments to picture size to accommodate all sizes of pictures.

Another example of the prior art is Smith, U.S. Pat. No. 1,338,258, which discloses an adjustable picture frame having a plurality of backing sectional pieces over which four corner sections may be placed. Smith further includes wing nut attachments for securing all of the various sections of Smith to one another. Clearly, however, Smith is not conducive to simple adjustment of the size of the picture frame, instead requiring unscrewing of the wing nuts, addition of a desired number of sections, and realignment of the sections to fit within the frame dimensions. Furthermore, as in Klimowicz, a cable is required for securing the frame sections to each other. Clearly, this detracts from the appearance of the frame and renders Smith unsuitable for public display of paintings. There is therefore a need for an adjustable picture frame which may be quickly and easily adjusted and which will present a finished and refined appearance for display of pictures held therein.

Therefore an object of the present invention is to provide an improved adjustable picture frame.

Another object of the present invention is to provide an adjustable picture frame which provides for fractional adjustment of the frame size to accommodate any sized picture.

Another object of the present invention is to provide an adjustable picture frame which may support a variety of types of artwork, including but not limited to oil paintings, posters, photographs and lithographs.

Another object of the present invention is to provide an adjustable picture frame in which the frame sections are not secured to one another by cable or fiber paper, thus eliminating features which detract from the overall appearance of the adjustable frame.

Another object of the present invention is to provide an adjustable picture frame in which the connection means between the frame sections consist of a dowel mounted on one section and a dowel-receiving socket formed in the an adjacent section, the dowel being inserted into the dowel-receiving socket and being retained therein by a securement pin extending through the adjacent frame section into a hole formed in the dowel.

Another object of the present invention is to provide an adjustable picture frame in which the connection means adjustable picture frame in which the connection means between the frame sections consists of a dowel mounted on one section and a dowel-receiving socket formed in an adjacent section, the dowel including transverse outwardly extending ridges formed on the exterior of the dowel, the dowel-receiving socket including ridge-receiving grooves formed on the outer edges of the socket such that when the dowel is inserted into the dowel-receiving socket, the ridges on the dowel engage and fit into the grooves in the socket, thus securing the dowel in the socket.

Another object of the present invention is to provide an adjustable picture frame having a plurality of fixed ninety degree corner sections to provide for additional stability for the adjustable frame.

Finally, an object of the present invention is to provide an adjustable picture frame which is simple and durable in construction and efficient and sturdy in use.

SUMMARY OF THE INVENTION

The present invention provides an adjustable picture frame which may be adapted to fit a wide variety of picture sizes.

The picture frame includes a generally polygonal frame including a plurality of elongated side sectional pieces. Each side sectional piece includes a first end face which includes a longitudinally projecting dowel mounted on the first end face and a second end face opposite the first end face including a dowel-receiving socket projecting toward the first end face and formed in the second end face, the dowel-receiving socket adapted to receive a dowel projecting from an adjacent sectional piece. The frame also includes a plurality of right angle corner sectional pieces for completing the generally polygonal frame. Each corner sectional piece includes a first end face which includes a longitudinally projecting dowel mounted on the first end face and a second end face opposite and generally perpendicular to the first end face including a dowel-receiving socket projecting longitudinally inwards and formed in the second end face, the dowel-receiving socket adapted to receive a dowel projecting from an adjacent sectional piece. The corner sectional pieces are adapted to contact adjacent side sectional pieces, the dowel-receiving socket on the corner sectional piece adapted to receive a dowel of adjacent side sectional piece and the dowel on the corner sectional piece adapted to fit into a dowel-receiving socket of a second adjacent side sectional piece whereby the polygonal frame may be completed. Finally, a securement device, such as a securement pin or a plurality of ridges on the dowel and ridge-receiving grooves in the socket, is mounted on the frame, the securement device operative to removably secure adjacent sectional pieces in dowel-socket alignment together thereby forming a completed polygonal frame.

Additionally, adjacent sectional pieces may be secured to one another by providing a bore hole in each section extending upwards from the bottom wall of the sectional piece and connecting to the dowel-receiving socket. Likewise, each dowel on each sectional piece includes a transversely extended dowel bore hole. The sectional bore hole and dowel bore hole are formed such that upon insertion of the dowel of a first sectional piece into the dowel-receiving socket of a second sectional piece and alignment of the bottom walls of the first and second sectional pieces, the section bore hole and dowel bore hole are substantially aligned. Finally, a securement pin is provided, the pin adapted to be inserted into the section bore hole and of a length to extend upwards into the dowel bore hole upon alignment of the bore holes such that adjacent sectional pieces may be releasably secured to one another.

Alternatively, the dowel may include a plurality of transverse, outwardly extending resilient ridges, the socket including a plurality of outwardly extending ridge-receiving grooves adapted to receive the ridges on the dowel when the dowel is inserted into the socket. In this manner, the dowel may be secured within the socket by frictional and mechanical contact.

The present invention also contemplates providing a plurality of fractional sectional pieces each having a length substantially less than that of a side sectional piece to provide for fractional adjustment of the dimensions of the adjustable picture frame. Each of the fractional sectional pieces would likewise include a dowel affixed at one end and a dowel-receiving socket formed in the opposite end to provide for connection to adjacent side and corner sectional pieces.

Throughout this specification, reference to "sectional pieces" shall be understood to include any of the side, corner or fractional sectional pieces, as each of the three types of pieces include substantially similar elements.

As can readily be seen from the above description, this adjustable picture frame provides a simple, efficient and precise apparatus for enclosing a variety of picture sizes. Furthermore, as the means for securing the sectional pieces to one another is substantially hidden from view (i.e. is on the bottom wall which will be adjacent a hanging wall), the adjustable picture frame of the present invention provides a substantially more refined appearance than those frames disclosed in the prior art. Additionally, as the present invention provides a plurality of right angle corner sectional pieces, stability of the picture frame is substantially increased. Therefore, the present invention provides a substantial improvement over the prior art.

DESCRIPTION OF THE PREFERRED EMBODIMENT

The adjustable picture frame 10 is shown in its preferred embodiment in FIGS. 1–4 as including a plurality of side sectional pieces 12, 14, 16 and 18 which extend between a plurality of corner sectional pieces 20, 22, 24 and 26.

Figure 3:
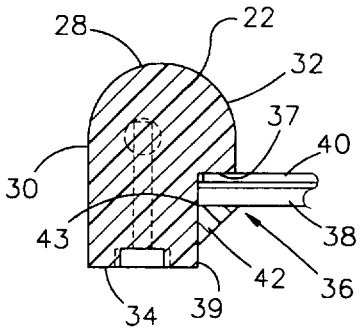
FIG. 3 is a side sectional view of the picture frame.

FIG. 3 shows a sectional view of a corner sectional piece 22, the sectional piece 22 including a semi-cylindrical upper wall 28, an outer wall 30, an inner wall 32 and a bottom wall 34. It is preferred that each corner and side sectional piece include a notch 36 having a top wall 37 and a vertically extended side wall 39, the notch 36 extending outwards from the inner wall 32 and contacting the bottom wall 34 to accommodate a picture 38 within the notch 36, the notch preferably extending the length of the sectional piece. It is to be understood that while the above description refers to a corner sectional piece, the side sectional pieces 12, 14, 16 and 18 are each constructed to have a similar cross-section as that shown in FIG. 3. In this manner, when the adjustable picture frame 10 is fully assembled, the entire frame has substantially the same cross-sectional shape.

For securing the picture 38 within the notch 36, a plurality of picture securement wedges 42 (FIG. 2) are mounted by adhesive or any suitable fasteners on the side wall 39 of the notch 36 such that the right angle corner 43 of the wedge 42 is adjacent the side wall 39. To secure the picture 38 and glass 40 within the frame 10, the wedges 42 are secured to respective side walls 39 of notches 36 in sectional pieces such that each wedge 4Z contacts the backside of the picture 38, thus securing the picture 38 and glass 40 between each wedge 42 and the respective top wall 37 of a sectional piece. The use of wedges 42 for securement of the picture 38 and glass 40 has the further advantage of being adjustable to secure a variety of types of artwork. For example, oil paintings and the like consist of 1" thick wooden frame boxes over which the painted canvas is stretched. Therefore, there must be at least a 1¼" space between a wedge 42 and the top wall 37 of the notch 36 on which the wedge 42 is mounted to allow the painting to be held by the frame 10. On the other hand, many posters and prints need only a ¾" space between the wedge 42 and top wall 37. As the wedges 42 may be secured in any position along the side walls 39, a limitless number of types of artwork may be supported and displayed by the present invention.

It is preferred that each of the side sectional pieces 12, 14, 16 and 18, corner sectional pieces 20, 22, 24 and 26 and wedges 42 be constructed of a hard plastic or pressed composition material, thus producing a relatively low-cost adjustable picture frame which will not be easily damaged.

It is not critical that the frame sectional pieces be either solid or hollow, but only that the pieces have sufficient structural strength to retain a frame shape. To this end, the sectional pieces may be formed by injection molding, blow molding or any other suitable manufacturing method. Of course, a variety of other construction materials may be used, such as wood, metal or other such materials commonly used in the construction of picture frames.

Figure 7:
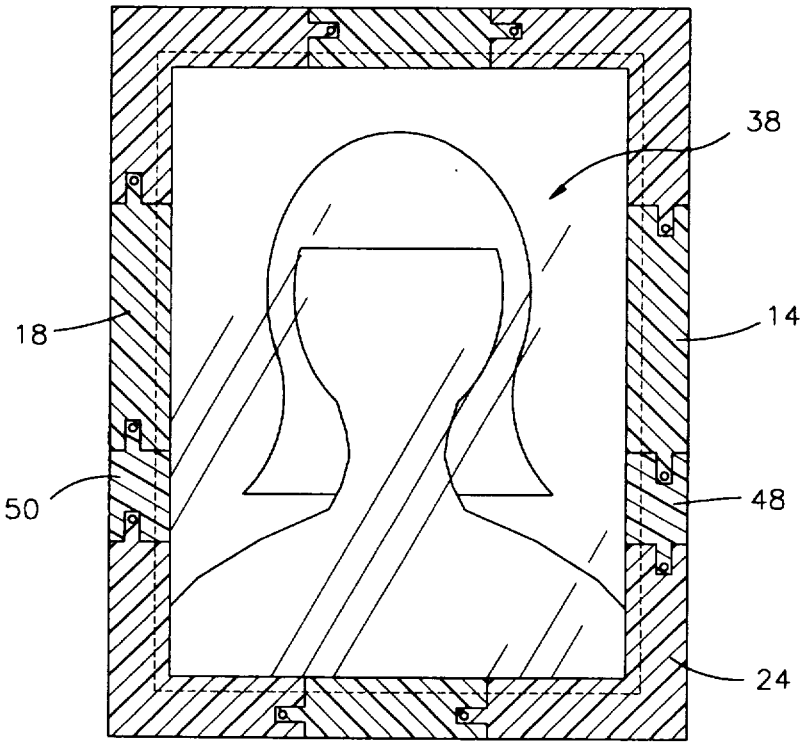
FIG. 7 is a front sectional view of the picture frame including several fractional sectional pieces.

FIG. 7 shows a front sectional view of the adjustable picture frame 10 of the present invention further including several fractional sectional pieces 48 and 50. These fractional sectional pieces 48 and 50 are designed to be interposed between side sectional pieces or corner sectional pieces thereby adjusting the overall dimensions of the frame 10. For example, a preferred embodiment of the present invention would include side sectional pieces which are formed having various lengths, such as three inches of length or five inches in length. It may be necessary, however, to adapt the dimensions of the adjustable picture frame 10 to fit an odd-sized picture, such as a metric-sized print. To perform this function, a variety of sized fractional sectional pieces 48 and 50 are provided, in one embodiment the fractional sectional pieces each having a length of one and three quarters of one inch (1 ¾), two and a quarter inches (2 ¼) and two and a half inches (2 ½). In this manner, the dimensions of the adjustable picture frame 10 may be adjusted within one quarter inch (¼) of the actual size of the picture.

It is preferred that each of the fractional sectional pieces 48 and 50 have the same cross section as was previously described in conjunction with the side sectional pieces 14. The fractional sectional pieces 48 and 50 may therefore be interposed between various sectional pieces without disrupting the overall appearance of the adjustable picture frame 10. It is preferred that the fractional sectional pieces 48 and 50 be constructed of materials similar to that used in constructing the side and corner sectional pieces.

Figure 1:
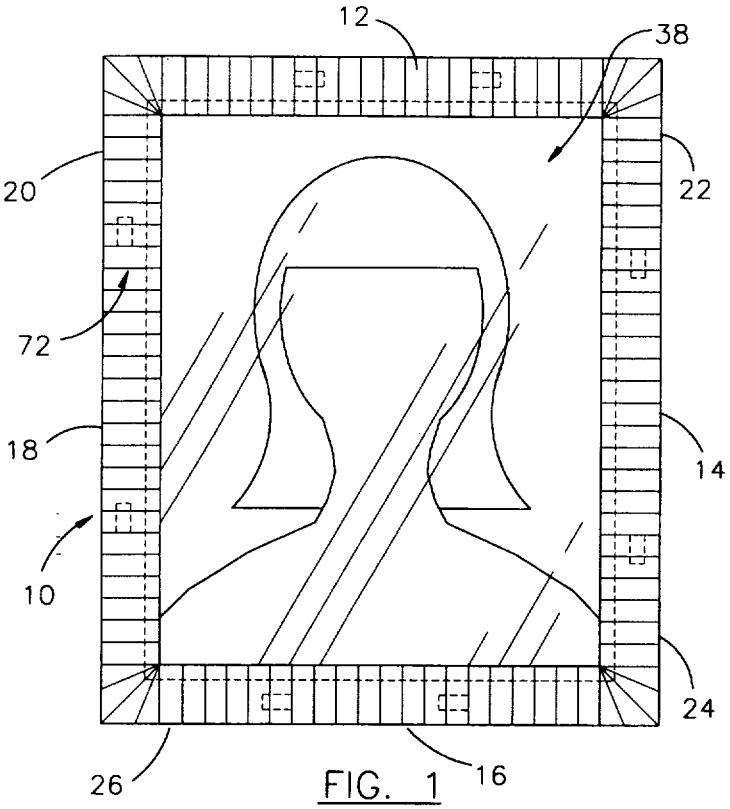
FIG. 1 is a front elevational view of the picture frame of the present invention.

One embodiment of the present invention would include a plurality of lines or grooves 72 formed on the outer faces of each of the upper walls of the sectional pieces, as shown in FIG. 1. This is done to disguise the joints between sectional pieces, thereby presenting a more refined appearance. Of course, a variety of patterns may be used to disguise the joints, of which the above is only one.

Figure 6:
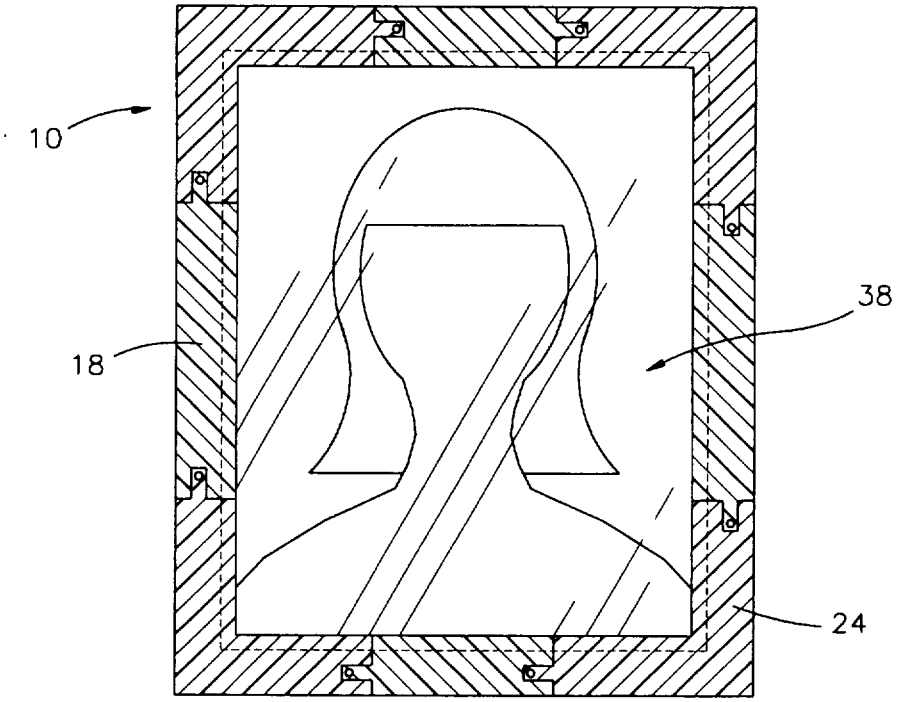
FIG. 6 is a front sectional view of the picture frame taken along line 5—5 of FIG. 5.

To secure the side, corner and fractional pieces together, each piece includes a longitudinally extended dowel 52 projecting from one end of a sectional piece and a dowel-receiving socket 54 formed in the opposite end of a sectional piece, as shown in FIGS. 6 and 7. It is preferred that each dowel 52 extend perpendicularly from a first end face 56 of a sectional piece, the dowel preferably being between one quarter (¼) and three quarters (¾) of an inch in length and between one eighth (⅛) and one half (½) inches in width. It is preferred that the dowel 52 be generally cylindrical in shape, however, the precise shape is not critical to the invention.

Figure 8:
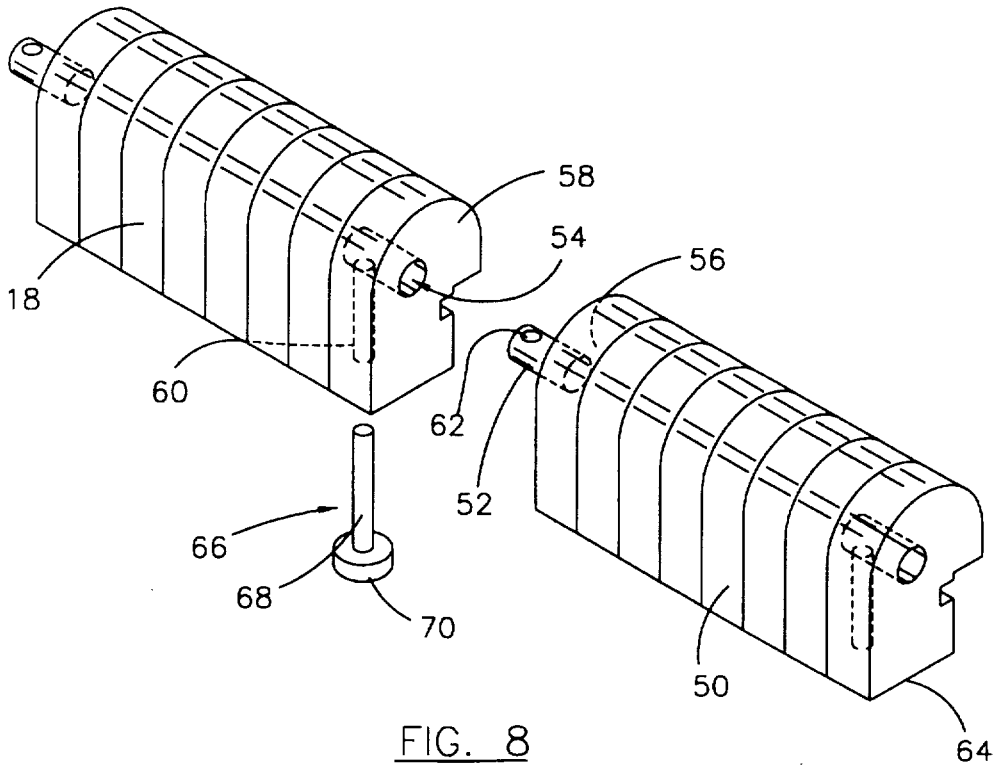
FIG. 8 is a perspective detail view of a two side sectional pieces prior to connection.

The dowel-receiving socket 54, shown best in FIG. 8, is formed in a second end face 58 of a sectional piece 14. Each dowel-receiving socket 54 preferably has dimensions only slightly larger than that of the dowel 52 to thereby allow the dowel 52 to snugly fit into the dowel-receiving socket 54. For example, to accommodate a dowel having an outer diameter of one quarter (¼) inch, a dowel-receiving socket 54 would preferably have an inner diameter between nine thirty-secondths (9/32) of an inch and three eights (⅜) of an inch. Likewise, for a dowel 52 having a length of one half (½) inch, the dowel-receiving socket 54 would preferably have a length between seventeen thirty-secondths (17/32) of an inch and three quarters (¾) of an inch.

It is preferred that the dowel 52 be constructed of materials similar to that used in constructing the side and corner sectional pieces, and the dowel-receiving socket 54 be formed by injection molding or drilling or other such hole-forming technique.

Figure 4:
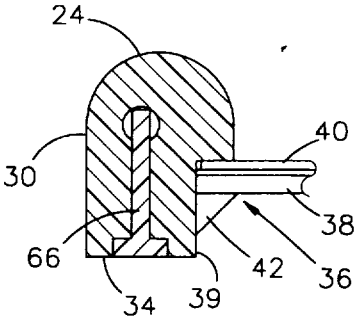
FIG. 4 is a side sectional view of the picture frame taken along line 4—4 of FIG. 2.
Figure 9:
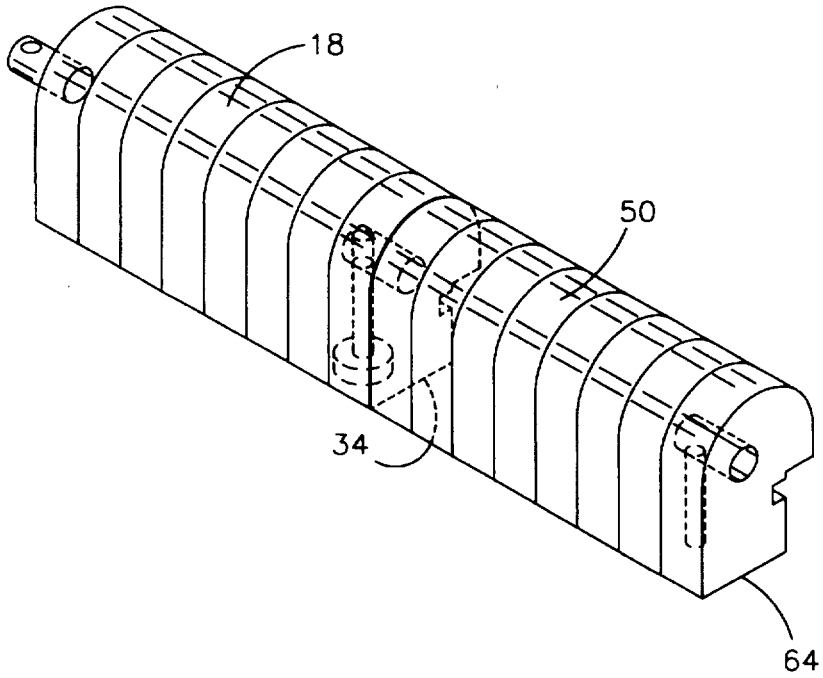
FIG. 9 is a perspective detail view of two side sectional pieces connected to one another by the securement pin.

FIGS. 4 and 9 illustrate the preferred system for attaching sectional pieces to one another, the system consisting of an interfitting dowel 52 and dowel-receiving socket 54 on a pair of sectional pieces. To secure the dowel 52 within the dowel-receiving socket 54, a section bore hole 60 is formed extending upwards from the bottom wall 34 of the sectional piece 18 and contacting dowel-receiving socket 54 adjacent the second end face 58 of the sectional piece 18. The dowel 52 further includes a dowel bore hole 62 which extends transversely through the dowel 52, as shown in FIG. 9. The section bore hole 60 and dowel bore hole 62 are formed such that upon insertion of the dowel 52 of a first sectional piece 50 into the dowel-receiving socket 54 of a second sectional piece 18 and alignment of the bottom walls 64 and 34, respectively, of the sectional pieces, the section bore hole 60 and dowel bore hole 62 are placed in substantial alignment.

Following alignment of the section bore hole 60 and dowel bore hole 62, a securement pin 66 may be inserted into the section bore hole 60 extending upwards into the dowel bore hole 62, the pin 66 being secured therein by frictional engagement with the walls of the bore holes 60 and 62. The securement pin 66 includes a pin shaft 68 and a head 70, the head 70 preferably having a width greater than the diameter of the section bore hole 60 to prevent the securement pin 66 from extending into the section bore hole 66 past the head 70 of the pin 66.

When the securement pin 66 is fully inserted into the section bore hole 60, the securement pin 66 extends into the dowel bore hole 62 thus releasably securing the first sectional piece 18 to the second sectional piece 50, as shown in FIG. 9. In a preferred embodiment, the securement pin 66 would be generally cylindrical in shape, having a diameter between one sixteenth (1/16) and one quarter (¼) of one inch. Therefore, the section bore hole 60 and dowel bore hole 62 would have diameters slightly greater than the diameter of the securement pin 66 to provide for frictional engagement of the walls of the bore holes 60 and 62 by the securement pin 66. Adjacent sectional pieces may thus be releasably secured to one another by this method. It is to be understood, however, that the combination of the securement pin 66 and bore holes 60 and 62 represents only one possible method for securing adjacent sectional pieces to one another, and should not be read as limiting the scope of this invention, which is set forth in the claims.

Figure 10:
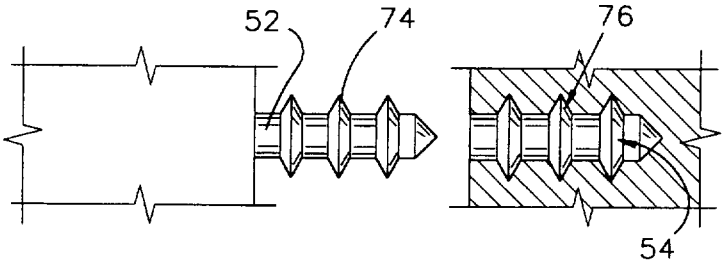
FIG. 10 is a partial detail side elevational view of an alternative securement device for securing sectional pieces to one another.

FIG. 10 displays an alternative securement means for securing adjacent sectional pieces to one another. In this embodiment, the dowel 52 includes a plurality of transverse, outwardly-extending ridges 74, each of which preferably extend circumferentially around the outer surface of the dowel 52. For receiving the modified dowel 52 of FIG. 10, the dowel-receiving socket 54 is modified to include a plurality of transverse, outwardly-extending ridge-receiving grooves 76 formed on the outer surface of the dowel-receiving socket 54. The ridges 74 and grooves 76 are preferably arranged such that when the dowel 52 is completely inserted into the dowel-receiving socket 54, thus bringing the ends of the respective sectional pieces into contact with one another, the ridges 74 fit within and are held by respective ridge-receiving grooves 76. Of course, for the above described connection to function properly, the dowel 52 and ridges 74 should be constructed of a generally resilient material such as rubber or plastic. In this manner, the ridges 74 may deform to allow the dowel 52 to be inserted into the dowel-receiving socket 54, yet will resume their original shape after insertion thus extending into the ridge-receiving grooves 76. The connection method described above, then, allows for simple and quick connection of adjacent sectional pieces, and eliminates the need for securement pins or the like. It is believed that the combination of frictional and mechanical securement provided by this securement method results in a secure, stable adjustable picture frame 10.

Figure 2:
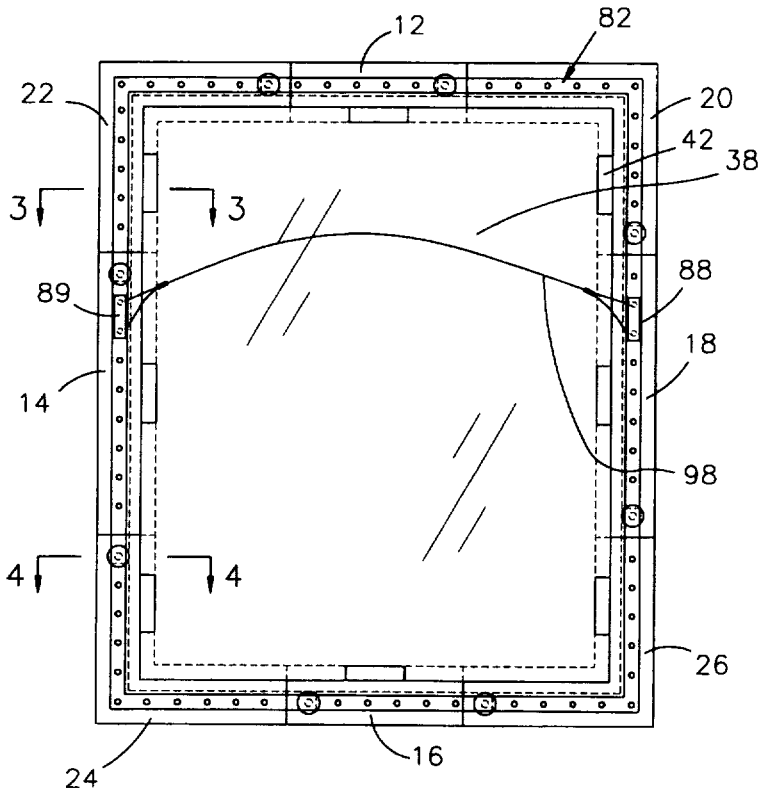
FIG. 2 is a rear elevational view of the picture frame taken along line 3—3 of FIG. 2.
Figure 5:
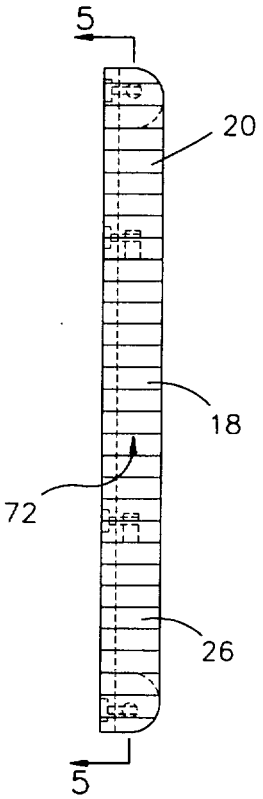
FIG. 5 is a side elevational view of the picture frame.
Figure 11:
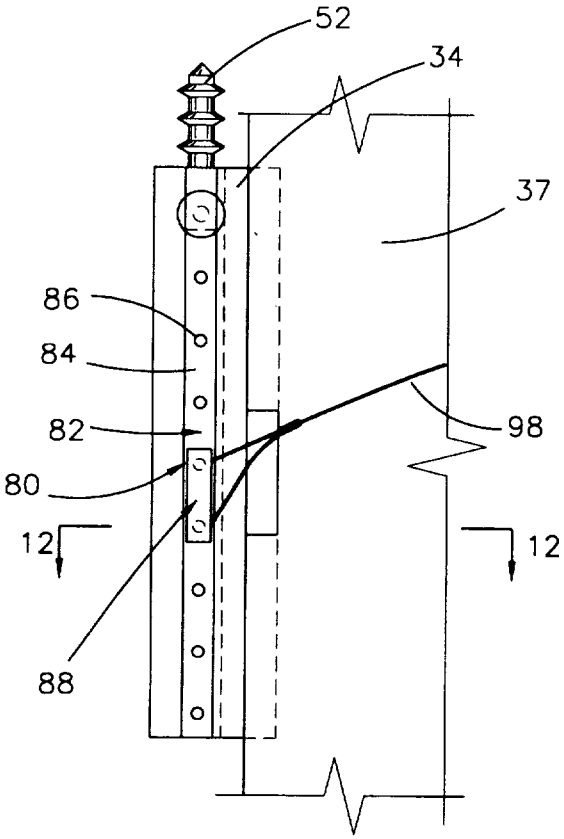
FIG. 11 is a rear elevational view of one sectional piece showing a preferred frame hanging device.
Figure 12:
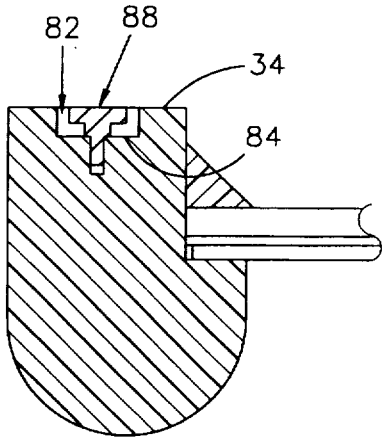
FIG. 12 is a partial end elevational view of the frame hanging device of FIG. 11.
Figure 13:
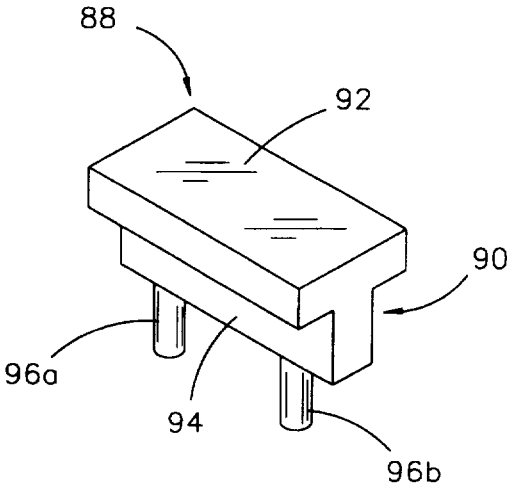
FIG. 13 is a detail perspective view of a frame hanging member.

FIGS. 11–13 illustrate a preferred frame hanging device 80 for use with the present invention. As shown in FIG. 11 a side sectional piece 18 includes a longitudinally extended channel 82 formed in the bottom wall 34 of the side sectional piece 18. As best seen in FIG. 12, a channel 82 preferably has a generally rectangular cross-section and in a preferred embodiment would have a depth between one quarter (¼) and three quarters (¾) of an inch. Formed in the base 84 of the channel 82 are a plurality of frame hanging member securement holes 86 which extend upwards into the sectional piece 18. In a preferred embodiment, these holes 86 would be aligned in a row, the row aligned with the longitudinal axis of the sectional piece 18 and be spaced between one half (½) and one (1) inch apart. It is preferred that each sectional piece include a channel similar to that described above which also includes the holes as described above, thus creating a generally continuous channel extending around the entire picture frame 10 on the back wall thereof, as shown in FIG. 2.

To enable the picture frame 10 of the present invention to be hung on a vertical support, a frame hanging member 88 is provided, the frame hanging member 88 being best shown in FIGS. 12 and 13 as including a T-beam 90 having a top flange 92 and stem 94. It is preferred that the T-beam 90 be formed in one piece to provide maximum structural strength. Depending downward from the stem 94 are a pair of securement pegs **96*a* and 96*b* which are preferably spaced apart such that the distance between the securement pegs 96*a* and 96*b* is equal to the distance between any adjacent pair of holes 86 in the channel 82. The securement pegs 96*a* and 96*b* may then be inserted into the holes 86, as shown in FIG. 12, the holes 86 being only slightly wider in diameter than the diameter of the securement pegs 96*a* and 96*b* in order to provide frictional contact between the sides of the holes 86 and outer surfaces of the securement pegs 96*a* and 96*b*. The frame hanging member 88 may thus be secured in any desired location around the frame 10**.

A second frame hanging member 89 would preferably be inserted into holes 86 on the opposite side of the frame 10 from the first frame hanging member 88, and a hanging wire 98 would then be looped around each frame hanging member 88 and 89 and extended between them to allow the frame 10 to be hung on a wall surface. Of course, it is to be understood that the T-beam shape of the frame hanging member 88 is not critical to the invention and may include any suitably shaped member having a stem section and a head section wider than the stem section to allow a wire to be hooked thereon.

There has thus been presented an adjustable picture frame which provides a simple, efficient and precise apparatus for enclosing a variety of picture sizes. Additionally, as the securement device for securing the sectional pieces to one another is substantially hidden from view, the adjustable picture frame of the present invention provides a substantially more refined appearance than those frames disclosed in the prior art. Therefore, it is believed that the present invention provides a substantial improvement over the prior art.

It is to be understood that numerous modifications and adjustments to the adjustable picture frame of the present invention may be performed. For example, the semi-cylindrical shape of the upper wall 28 of each sectional piece may be constructed of a different cross-sectional shape to provide for varying appearances of the adjustable picture frame of the present invention. Alternatively, the various sectional side and corner pieces may be constructed having various sizes, ranging from two to twelve inches in length. Therefore, the above description is not intended in any way to limit the scope of the present invention which shall follow in the claims set forth below.

There has thus been set forth and described an invention which accomplishes at least all of the stated objectives.

I claim:

1. An adjustable picture frame comprising:

a generally polygonal frame including a plurality of elongated side sectional pieces, each side sectional piece comprising;

a first end face including a longitudinally projecting dowel mounted on said first end face;

a second end face opposite said first end face including a dowel-receiving socket projecting towards said first end face and formed in said second end face, said dowel-receiving socket adapted to receive a dowel projecting from an adjacent sectional piece; and a plurality of right angle corner sectional pieces for completing said generally polygonal frame, each corner sectional piece comprising;

a first elongated arm section including a first section end face having a longitudinally projecting dowel mounted thereon and an opposite first joint end face;

a second elongated arm section including a second section end face opposite and perpendicular to said first section end face and having a dowel-receiving socket projecting longitudinally inward therefrom, said dowel-receiving socket adapted to receive a dowel projecting from an adjacent sectional piece and an opposite second joint end face;

said first and second arm sections connected to each other at said opposite first and second joint end faces, said first and second arm sections forming a generally L-shaped right angle corner sectional piece;

said corner sectional pieces adapted to contact adjacent side sectional pieces, said dowel-receiving socket on said corner sectional pieces adapted to receive a dowel of an adjacent side sectional piece and said dowel on said corner sectional piece adapted to fit into a dowel-receiving socket of a second adjacent side sectional piece whereby said polygonal form may be completed;

said side sectional pieces each further comprising an inner wall extending along a longitudinal axis and a bottom wall adjacent said inner wall and extending outward therefrom and said corner sectional pieces each further comprising an inner corner wall extending along a longitudinal axis and a bottom corner wall adjacent said inner corner wall and extending outward therefrom; and securement means mounted on said frame, said securement means operative to releasably secure adjacent sectional pieces together in dowel within socket alignment thereby forming a completed polygonal frame, said securement means further comprising;

a section bore hole extending upwards from said bottom wall and contacting said dowel-receiving socket;

said longitudinally projecting dowel further including a transversely extended dowel bore hole formed in said dowel;

said section bore hole and said dowel bore hole formed such that upon insertion of a dowel of a first sectional piece into the dowel-receiving socket of a second sectional piece and alignment of said bottom walls of said first and second sectional pieces, said section bore hole and said dowel bore hole are substantially aligned; and at least one securement pin adapted to be inserted into said section bore holes and of a length to extend upwards into said dowel bore hole upon alignment of said bore holes such that adjacent sectional pieces are releasably secured to one another.

2. The frame of claim 1 further comprising a notched section formed in said inner wall extending outwards therefrom and extending downwards contacting said bottom wall forming said notched section having a wall and a notch top wall, said section adapted to accept an edge of artwork therein.

3. The frame of claim 2 further comprising picture securement means for securing artwork adjacent said frame, said picture securement means comprising at least one transversely extended wedge having two generally perpendicular side faces and a rear face, said wedge having one of said side faces adapted to be secured to said notch side wall such that the other of said side faces engages the back face of artwork being held therein, thereby securing artwork within and adjacent to said frame.

4. The frame of claim 1 further comprising picture securement means for securing a picture adjacent said frame.

5. The frame of claim 1 further comprising frame hanging means for securing said frame on a vertical wall surface, said frame hanging means comprising:

at least one frame hanging member having a stem portion and a head portion, said head portion extending transversely outwards from said stem portion such that a wire retaining area is formed; and a member retaining means formed in at least one sectional piece, said member retaining means operative to accept and secure at least a portion of said frame hanging member such that a secure frame hanging connection is formed.

6. The frame of claim 1 further comprising a plurality of fractional sectional pieces for providing dimensional adjustment of said polygonal frame, each of said fractional sectional pieces comprising:

a bottom wall extending along a longitudinal axis;

a first end face including a longitudinally projecting dowel mounted on said first end face;

a second end face opposite said first end face including a dowel-receiving socket projecting towards said first end face and formed in said second end face, said dowel-receiving socket adapted to receive a dowel from an adjacent sectional piece;

said fractional sectional pieces adapted to be interposed between adjacent side sectional pieces and corner sectional pieces and secured therebetween, said dowel on said fractional sectional piece adapted to fit into a dowel-receiving socket in an adjacent sectional piece, said dowel-receiving socket adapted to receive a dowel projecting from a second adjacent sectional piece;

said fractional sectional pieces operative to provide adjustment for frame dimensions in smaller length increments than with said side sectional pieces, said fractional sectional pieces having a smaller longitudinal length than said side sectional pieces; and fractional securement means mounted on said frame, said securement means operative to releasably secure adjacent fractional, side and corner sectional pieces together in dowel within socket alignment thereby forming a completed polygonal frame.

7. The frame of claim 6 wherein said fractional securement means further comprises a fractional section bore hole extending upwards from said bottom wall and contacting said dowel-receiving socket of said fractional sectional piece and at least one securement pin adapted to be inserted into said fractional sectional bore hole and of a length to extend upwards into a dowel bore hole of a dowel extending within said dowel-receiving socket upon alignment of said bore holes such that adjacent fractional, side and corner sectional pieces are releasably secured to one another.

8. The frame of claim 1 wherein said securement means comprises at least one generally circumferential transverse ridge formed on each of said dowels and extending outwardly therefrom and at least one generally circumferential transverse groove formed extending outwards from each of said dowel-receiving sockets, said ridges and said grooves adapted to interfit when said dowel is inserted into said socket such that adjacent sectional pieces are frictionally and mechanically secured to one another.

9. An adjustable picture frame comprising:

a generally polygonal frame including a plurality of side sectional pieces, each side sectional piece comprising:

an inner wall extending along a longitudinal axis;

a bottom wall adjacent said inner wall and extending outward therefrom;

a notched section formed in said inner wall extending outward therefrom and extending downwards contacting said bottom wall forming a notched section for accepting an edge of a picture therein;

said side sectional piece further including picture securement means operative to secure a picture adjacent said frame;

a first end face connected to said inner wall and said bottom wall, said first end face including a longitudinally projecting dowel mounted on said first end face;

a second end face opposite said first end face and connected to said inner wall and said bottom wall, said second end face including a dowel-receiving socket projecting towards said first end face and formed in said second end face, said dowel-receiving socket adapted to receive a dowel projecting from an adjacent sectional piece;

a section bore hole extending upwards from said bottom wall and contacting said dowel-receiving socket;

said longitudinally projecting dowel further including a transversely extended dowel bore hole formed in said dowel;

said section bore hole and said dowel bore hole formed such that upon insertion of a dowel of a first sectional piece into the dowel-receiving socket of a second sectional piece and alignment of said bottom walls of said first and second sectional pieces, said section bore hole and said dowel bore hole are substantially aligned;

a securement pin adapted to be inserted into said section bore hole and a length to extend upwards into said dowel bore hole upon alignment of said bore holes such that adjacent sectional pieces are removably secured to one another; and a plurality of corner sectional pieces for completing said generally polygonal frame, each corner sectional piece comprising:

a first arm section including;

a first section inner wall extending along a longitudinal axis;

a first section bottom wall adjacent said first section inner wall and extending outward therefrom;

a notched section formed in said first section inner wall extending outward therefrom and extending downwards contacting said first section bottom wall forming a notched section for accepting an edge of a picture therein;

said first arm section further including picture securement means operative to secure a picture adjacent said frame;

a first corner end face connected to said first section inner wall and said first section bottom wall, said first end face including a longitudinally projecting dowel mounted on said first end face;

a second arm section including;

a second section inner wall extending along a longitudinal axis;

a second section bottom wall adjacent said second section inner wall and extending outward therefrom and extending downwards contacting said second section bottom wall forming a notched section for accepting an edge of a picture therein;

said second arm section further including picture securement means operative to secure a picture adjacent said frame;

a second corner end face opposite and perpendicular to said first corner end face and connected to said second section inner wall and said second section bottom wall, said second corner end face including a dowel-receiving socket formed in said second corner end face and projecting longitudinally inward, said dowel-receiving socket adapted to receive a dowel projecting from an adjacent sectional piece;

a section bore hole extending upwards from said second section bottom wall and contacting said dowel-receiving socket;

said longitudinally projecting dowel on said first corner end face further including a transversely extended dowel bore hole formed in said dowel;

said section bore hole and said dowel bore hole formed such that upon insertion of a dowel of a first sectional piece into the dowel-receiving socket of a second sectional piece and alignment of said bottom walls of said first and second sectional pieces, said section bore hole and said dowel bore hole are substantially aligned;

said first and second arm sections each further including adjacent end faces adapted to be secured to one another such that said first arm section is generally perpendicular to said second arm section thereby forming a generally right angle corner sectional piece; and said corner sectional piece adapted to contact adjacent side sectional pieces, said dowel-receiving socket on said second arm section of said corner sectional piece adapted to receive the dowel of an adjacent side sectional piece and said dowel on said first arm section of said first arm section of said corner sectional piece adapted to fit into the dowel-receiving socket of a second adjacent side sectional piece whereby said polygonal frame may be completed.

* * * * *